US005392710A

United States Patent [19]

Li

[11] Patent Number: 5,392,710

[45] Date of Patent: Feb. 28, 1995

[54] MODULAR FEEDER PRINTING SYSTEM

[76] Inventor: Raymond Li, P.O. Box 13007, St. John's, Newfoundland, Canada, A1B 3V8

[21] Appl. No.: 76,764

[22] Filed: Jun. 15, 1993

[51] Int. Cl.[6] ..... B41F 5/04

[52] U.S. Cl. ..... 101/219; 101/232; 101/479; 271/10; 271/264

[58] Field of Search ..... 101/232, 247, 248, 212, 101/216-217, 180-183, 479, 219-220, 143; 270/101, 53; 271/9, 10, 265, 264, 263, 164, 303; 400/624, 625

[56] References Cited

U.S. PATENT DOCUMENTS

| | | | |
|---|---|---|---|
| 2,158,701 | 5/1939 | Jirousek . | |
| 2,283,003 | 5/1942 | Frostad et al. . | |
| 2,593,414 | 5/1952 | Morse | 101/177 |
| 2,598,414 | 5/1952 | Morse . | |
| 3,286,622 | 11/1966 | Mestre . | |
| 3,470,816 | 10/1969 | Piecha et al. . | |
| 3,598,050 | 8/1971 | Thompson . | |
| 3,610,144 | 10/1971 | Woessner et al. . | |
| 3,999,480 | 12/1976 | Yamamoto | 101/232 |
| 4,038,921 | 8/1977 | Harrison et al. | 101/232 |
| 4,046,070 | 9/1977 | Halley . | |
| 4,134,341 | 1/1979 | Weigele et al. | 101/479 |
| 4,197,797 | 4/1980 | Rayfield et al. | 271/265 |
| 4,297,025 | 10/1981 | Bach et al. | 271/9 |
| 4,381,705 | 4/1983 | Roes et al. | 271/303 |
| 4,560,293 | 12/1985 | McCumber et al. | 101/232 |
| 4,616,564 | 10/1986 | Faddis et al. . | |
| 4,798,373 | 1/1989 | Hyltoft | 271/10 |
| 4,798,374 | 1/1989 | Ito | 400/625 |
| 4,865,305 | 9/1989 | Momiyama et al. | 400/624 |
| 5,021,837 | 6/1991 | Uto et al. | 270/53 |
| 5,040,777 | 8/1991 | Bell et al. | 271/223 |
| 5,092,575 | 3/1992 | Ramsey | 271/223 |
| 5,152,520 | 10/1992 | Farrell et al. | 277/10 |
| 5,169,141 | 12/1992 | Ahl et al. | 271/263 |
| 5,203,552 | 4/1993 | Hoshi et al. | 271/164 |
| 5,207,412 | 5/1993 | Coons et al. | 270/1.1 |

FOREIGN PATENT DOCUMENTS

| | | | |
|---|---|---|---|
| 1101727 | 5/1981 | Canada . | |
| 1520360 | 4/1968 | France | 101/232 |
| 1047217 | 12/1958 | Germany | 101/232 |

*Primary Examiner*—Eugene H. Eickholt
*Attorney, Agent, or Firm*—Ezra Sutton

[57] ABSTRACT

A modular feeder printing system is provided herein. It includes at least one, e.g., four, printing unit(s) and at least one, e.g., six, feeder module(s). An alignment means is incorporated at an end of each of the printing unit(s), such alignment means being adapted to be connected to an associated feeder module, preferably by means of a complementary alignment means which is incorporated at an end of each of the feeder module(s). The complementary alignment means is alignable and engageable with the alignment means. Latch means are cooperatively associated with the alignment means, in order to secure a selected printing unit to a selected feeder module. Finally, coupling means couple and synchronize drive power from the printing unit to the connected feeder module. By this module printing press, there is a substantial reduction in set-up time. This means that multiple printing press units can be configured in a suitable configuration to faciliate quality control of multiple presses by one operator at a central location. The standardization of settings on the feeder modules, when used with procedures for accurately positioning the printing image on the printing plates, further allows for almost instant registration of the image position on the printing sheet.

12 Claims, 6 Drawing Sheets

MODULAR FEEDER PRINTING SYSTEM

BACKGROUND OF THE INVENTION

This invention relates to a modular feeder printing system.

DESCRIPTION OF THE PRIOR ART

Hitherto it has been preferred to design and build printing presses incorporating the paper feeder and registration mechanisms as an integral part of each press. The feeder and registration mechanisms need to be adjusted to feed each variation in paper format (type, size, and weight). Such presses have thus been made as integral, in-line units. Such in-line units consisted of a paper feed system, to deliver the printing sheets into the press; a registration system, to position the sheets in an accurate and consistent position in preparation for printing impression; an impression system, to transfer ink in a controlled manner onto a printing plate, onto an intermediate printing blanket, and finally onto the printing sheet. Many small presses utilize a secondary color head to print two colours in one pass, and a delivery system, to receive and stack the printed sheets.

In many production environments, e.g., for printing letterheads, envelopes, business cards, forms, brochures, invitations, etc., these adjustments are necessary between each job, and are performed hundreds or even thousands of times a year. Furthermore, in many production environments, there are usually a small number of predominant paper formats which account for a majority of the printing jobs; therefore the same adjustments are repeated many times over. In order to produce a good quality printing job, all the component systems must be set up in perfect unison to accommodate the many variables in printing, namely: type of paper, i.e. surface finish, dimensions, thickness, grain of paper fibres, curl characteristics; special construction, i.e. envelope flaps; registration, e.g., accurate alignment of the image on the printing plate and the printing sheet, as well as registration of different colors on the sheet; dampening system, i.e. which must be adjusted properly in accordance with the ink coverage variables to produce clean sharp images free of scumming, emulsification, uneven coverage and other defects; and ink colors, location of images, and amount of ink coverage.

Since by setting up for the next paper format the settings of the previous format are always removed, these adjustments are very time consuming, and often cannot be optimally adjusted correctly at the outset. As a result, further refinements in the adjustments are often necessary while the printing job is in progress. Paper wastage and poor consistency in printing quality often results. Press speed often has to be maintained at low settings to help reduce feeding error, further reducing productivity.

It was thought that the principle of modularity which is, in fact, old in the art, could be used for the feeder and registration system to solve such problem. For example, U.S. Pat. No. 2,598,414 patented May 27, 1952 by L. H. Morse, provided an offset printing machine having a plurality of pattern rolls coacting with a single offset roll, whereby imprints may be made in a plurality of colors. In the patented invention, a printing machine was provided which included the combination, with a main frame, of a platen carried thereby. A supplemental frame was pivoted to the main frame. An offset roll was mounted in the supplemental frame and was adapted to coact with the platen. A second supplemental frame was pivoted on the same axis as the first supplemental frame. A pattern roll was mounted in the second supplemental frame, and an adjustable link tied the two supplemental frames together.

U.S. Pat. No. 3,470,816 patented Oct. 7, 1969 by G. Piecha et al provided a self-contained printing subassembly or unit for a rotary printing press. The subassembly was arranged to be mounted between two spaced-apart walls of the frame structure of the press by releasably securing the subassembly to one of the walls. The clear spacing between the walls was wider than the maximal width of the subassembly. Locating means were also provided to locate the subassembly in an exact predetermined position between the walls. Upon release of the first mounting means and the locating means, the subassembly was detachable as a unit from the frame structure to service the subassembly separated from the printing press, or to replace it by another subassembly. Such an arrangement was said to have the advantage that the subassembly could be rapidly and conveniently detached from the frame structure of the press for servicing or replacement. A reconditioned subassembly or another subassembly could be quickly and conveniently be installed to be automatically in the correct position.

U.S. Pat. No. 4,046,070 patented Sep. 6, 1977 by A. M. Halley provided a rotary printing press having mounting means for an image cylinder to facilitate interchange of cylinders of different sizes and their adjustment. The cylinder was carried on upstanding supports on a cradle. End stub shafts of the cylinder were journalled on the supports and one or both of the supports were adjustable longitudinally of the cradle to suit cylinders of various axial lengths. The cradle was movable in a frame of the press either horizontally so that it could be Withdrawn as a unit with the cylinder, or vertically for forming a nip with an impression cylinder. Each support had a bearing formation for receiving a respective journal of the image cylinder. Thus, the cradle was selectively movable in a frame of the press for positioning the image cylinder so journalled in operative relation to the impression cylinder.

U.S. Pat. No. 4,616,564 patented Oct. 14, 1980 by T. N. Fadder et al, and its corresponding Canadian Patent No. 1,101,727 patented May 26, 1981, provided a variable, modular, web-fed offset lithographic printing unit or tower which could be easily and quickly modified in the field using interchangeable modules so as to vary printing characteristics. The printing tower was provided with a printer module having upper and lower web-printing blanket rollers. In addition, the tower had corresponding upper and lower inker modules for the respective blanket rollers. The upper inker module was mounted for pivotal movement about a horizontal axis so that it could be shifted between a normal inking position over the printer module to a retracted, printed module-cleaning position allowing removal and/or replacement of the printer module by essentially vertical shifting of the printer module.

SUMMARY OF THE INVENTION

(i) Aims of the Invention

It is seen that prior art does not provide for means to save the settings for feeding a particular paper format for later use. Also, the prior art does not provide for means to transfer such settings from one press to another.

Accordingly, an object of this invention is to provide a modular feeder printing system whereby, in use, the correct settings for feeding and registration mechanisms on offset printing presses can be speeded up.

Another object of this invention is to provide a feeder printing system as a plurality of feeder and registration mechanisms, and configuring a number of feeder/registration assemblies on moveable modules which can be interchangeably connected and disconnected from each press unit in the printing system.

Yet another object of this invention is to provide such a feeder printing system that has a special subassembly for each format or size of the material to be printed upon so that a change-over from one type of material to another can be effected with much less labor and in a much shorter time than heretofore has been possible.

Still another object of this invention is to provide such a feeder printing system in which optimally adjusted settings on the feeder and registration system may be saved for later reuse, eliminating the adjustment process and paper wastage and enabling printing speed to be set at maximum almost immediately.

A still further object of the invention is to provide such a feeder printing system in which the feeder and registration modules, preset for a particular sheet format, may be easily transferred from one printing press to another without further resetting.

Another object of this invention to provide better means of incorporating specialized mechanisms on each feeder module to optimize performance with a particular paper format.

(ii) Statement of Invention

According to the present invention, the system consists of one or more printing units, with two or more feeder modules, preferably five or more. Each feeder module can be separated or connected to any press unit in the system. An alignment means is incorporated in each press and each feeder module to ensure accurate and consistent alignment between each press and each feeder module, and latch means are provided to secure feeder module to press unit while press is in operation. A coupling means provide synchronized drive power to modular feed means.

The present invention provides a modular feeder printing system for a sheetfed printing press comprising: (a) at least one printing unit; (b) at least one feeder module; (c) an alignment means incorporated at an end of each printing unit which is adapted to be connected to an associated feeder module; (d) a complementary alignment means incorporated at an end of each feeder module which is adapted to be connected to an associated printing unit, the complementary alignment unit being alignable and engagable with the alignment means; (e) latch means associated with the alignment means and the complementary alignment means to secure a printing unit to a feeder module; and (f) coupling means to couple and synchronize drive power from the printing unit to the connected feeder module.

The present invention also provides a sheet-fed offset printing press system including a printing unit, a clutch mechanism, alignment mechanisms, latching mechanisms, interface subframes, and electrical connections, the printing press comprising: a feeding section and a registration section, each such section being built as a separate module, each such feeding section and registration section being in the form of a moveable module, each such module having interchangeable connections, whereby such modules can be interchangeably connected and disconnected to any printing unit in the printing press system; the interchangeable connections being via interfaces which align with each other exactly for standardizing image positions.

(iii) Further Features of the Invention

In one feature of the invention, the alignment means (c) comprises a subframe secured to the printing unit, the subframe including one component of the latch means. By a variant of such feature, the subframe is secured to the printing unit by jack bolts to calibrate the exact position of each subframe.

In another feature of this invention, the modular feeder system includes an alignment system on the subframe which is secured to the feeder module, the alignment system being provided with a guide pin to guide such feeder module subframe into docking position.

In another feature of this invention, the complementary alignment means (d) comprises a subframe secured to the feeder module, the subframe including another component of the latch means. By a variant of such feature, the subframe is secured to the feeder module by jack bolts to calibrate the exact position of each subframe.

In yet another feature of this invention, the system includes a male clutch plate and female clutch plate in separate printing units and feeder modules engageable after the feeder module and the printer unit have been docked and latched, in order to transmit power automatically from the press unit to the feeder module. By a variant of such feature, the male clutch plate is secured to the feeder module and the female clutch plate is secured to the press unit.

In still another feature of this invention, the system includes a docking connection for electrical power, such docking connection including a plug and a receptacle on the feeder module and press unit respectively. By a variant of such feature, the plug is on the feeder module and the receptacle is in the press unit.

In a further feature of this invention, the latch mechanism is actuated by a foot treadle on the feeder unit.

In yet a further feature of this invention, the system includes alignment pins at the interface between the press unit and the feeder module to assure accuracy of docking.

By one feature of the sheet-fed offset printing press, the feeding and registration modules include casters to facilitate moving.

DESCRIPTION OF THE PREFERRED EMBODIMENT

Figure 1:
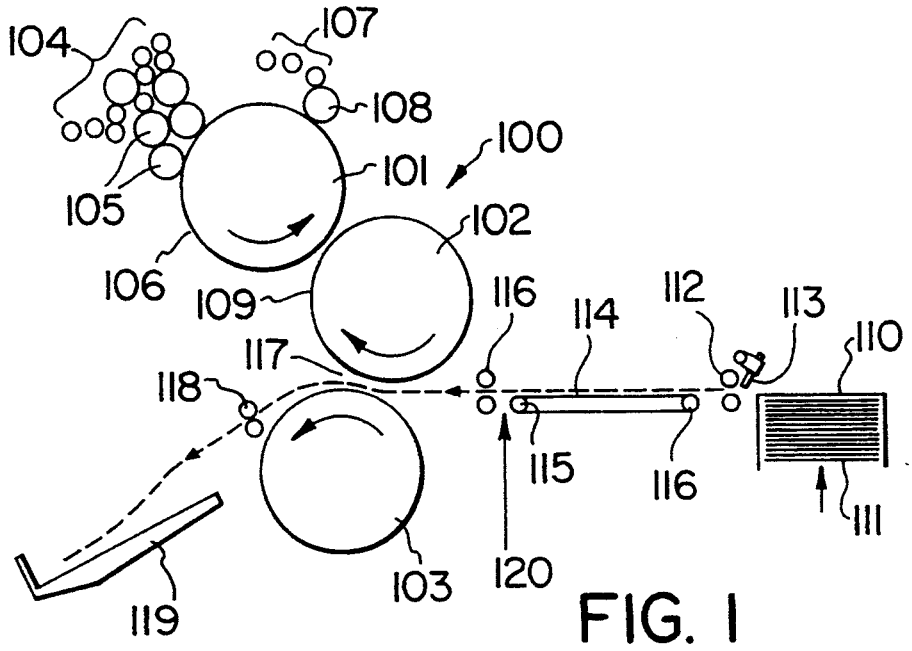
FIG. 1 is a schematic flow diagram of a typical offset press of the prior art, showing the operation thereof, and the manner by which it can be modified to utility in the present invention.

(i) Description of the Prior Art of FIG. 1 and Its Operation

As seen in FIG. 1, one embodiment of an offset printer 100 includes three cylinders, namely a master cylinder 101, a blanket cylinder 102, and an impression cylinder 103. An ink system 104 includes a plurality of ink form rollers 105. A plate 106 is secured to the master cylinder 101. Plate 106 which is formed of a sheet of metal or a special type of paper, has an image produced thereon. The image is made of a substance that has an affinity for grease-containing material, so that printer's ink (greasy) will tend to be held more strongly by the image than by the blank (un-imaged) area of the plate. Ink form rollers 105 are adapted to contact the plate 106. A moisture system 107 includes a plurality of moisture rollers 108. The moisture system is also adapted to contact the plate 106 on the master cylinder 101.

The blanket cylinder 102 has a rubber blanket 109 secured thereto. The rubber blanket 109 on the blanket cylinder 102 is adapted to be in contact with the plate 106 on the master cylinder 101.

Impression cylinder 103 is adapted to press paper being printed into contact with the rubber blanket 107 on the blanket cylinder 102.

The offset printer 100 also includes a paper tray 110 in which a pile of paper 111 is situated. The paper tray is adjacent a set of pullout wheels 112, preceded by vacuum feet 113 to separate individual paper sheets. Downstream from the pullout wheels 112 is a conveyor 114 consisting of a plurality of register board tapes, each entraining a forward roller 115 and a rearward roller 116. Downstream of the register-board tapes 114 is a pair of infeed rollers 116, between which an individual sheet of paper is gripped and fed to the impression cylinder 103.

The discharge end 117 of the impression cylinder is the site for a pair of outfeed rollers 118, which feed the individual sheets of printed paper to the receiving tray 119.

In the operation of the offset printer shown in FIG. 1, an image is produced on the plate 106, or master, which is a sheet of metal or special type of paper. The image is made of a substance that has an affinity for grease-containing material, so that printer's ink (greasy) will tend to be held more strongly by the image than by the blank (un-imaged) area of the plate.

Next, a moistening solution is manually applied to the surface of the plate 106. This application renders the clear (non-image) area repellant to ink while the image is not materially affected in its affinity for ink. The process is generally referred to as "pre-moistening".

At this point, the imaged plate is mounted on the master cylinder 101. Then, the machine 100 is turned on and the cylinders 101,102,103 begin to rotate in the directions shown by the arrows in the figure in the form of fountain solution is applied to the entire surface of the master on the master cylinder 101 when the control is in the moist position. The application of fountain solution maintains the condition initially established by the pre-moistening procedure.

The ink form rollers 105 are brought into contact with the ink system master cylinder 101, the image becomes inked while the clear area remains free of ink. The ink adheres to the image and is not driven off by the moisture because the attractive tendency of the image remains stronger than the repelling tendency of water. This condition is maintained as long as ink and moisture are applied in the proper amounts, in which case they are said to be "in balance".

After ink has been applied the master cylinder 101 is brought into contact with the rubber blanket 109 on the blanket cylinder 102, with the result that a reversed (or mirror) image is offset onto the blanket. This image is allowed to build up for a few revolutions of the blanket cylinder 102 before paper 111 is fed.

The vacuum feet 113 pick up the topmost sheet from the paper pile 111 and feed it to the pullout wheels 112. The pull-out wheels 112 feed the sheet onto the moving tapes of the register board 114. The tapes 114 in turn carry the sheet to the feed rollers 116, which in turn feed the sheet to the grippers of the impression cylinder 103.

A mechanism (not shown) detects the sheet and causes the impression cylinder 103 to press the sheet against the blanket 109 of the blanket cylinder 102 as the sheet passes through the nip formed by the impression cylinder 103 and the blanket cylinder 102. Consequently, the already reversed image on the blanket 109 is impressed upon the sheet and thereby is reversed again to become a right-reading image (as is the image on the master 106). When the leading edge of the sheet emerges from the nip of the cylinders, the grips open to release the sheet, and the sheet is then guided by rollers 118 into the receiving tray 119 (or onto the chain delivery unit if the duplicator is so equipped).

This process continues until the duplicator stops or runs out of supplies. The master 106 is continuously moistened and inked, with the flow rates of both ink and moisture so adjusted that the moisture input is equal to the moisture lost to the master 106, and the ink input is equal to the amount of ink used by the sheets.

When this system is applied to the present invention the cut-off point for the modular press system of the present invention is at point 120.

Figure 2:
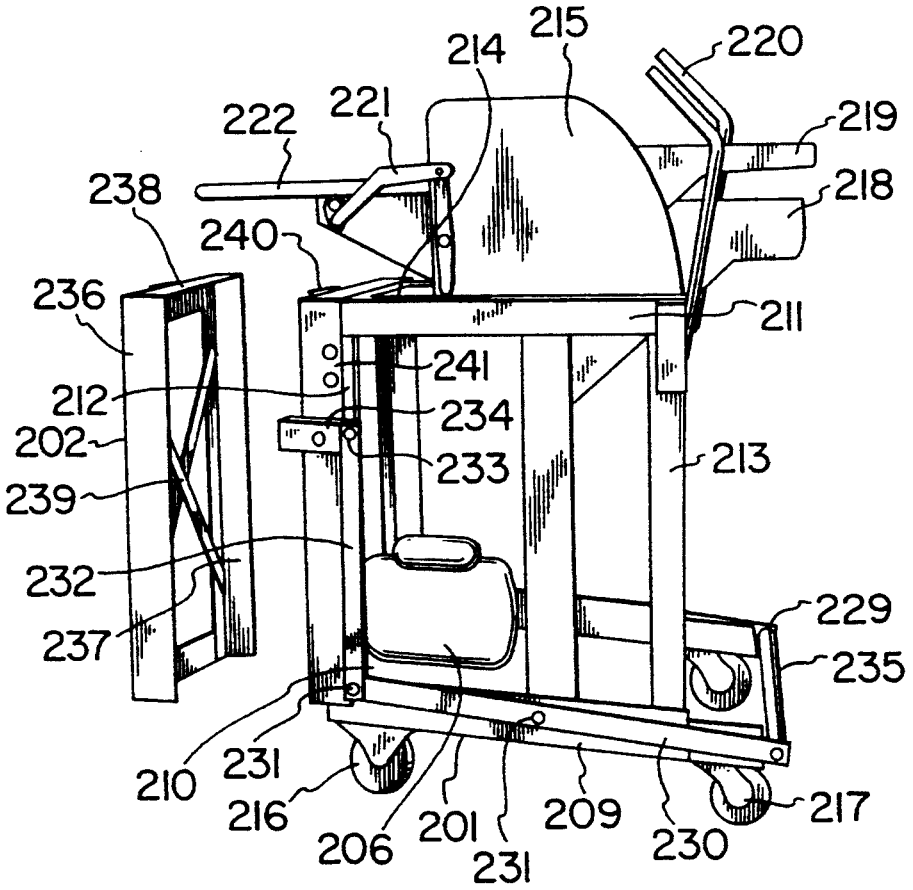
FIG. 2 is a side, partially-perspective view of one embodiment of a feeder module of an offset press of one embodiment of this invention, viewed from the operator's side.
Figure 3:
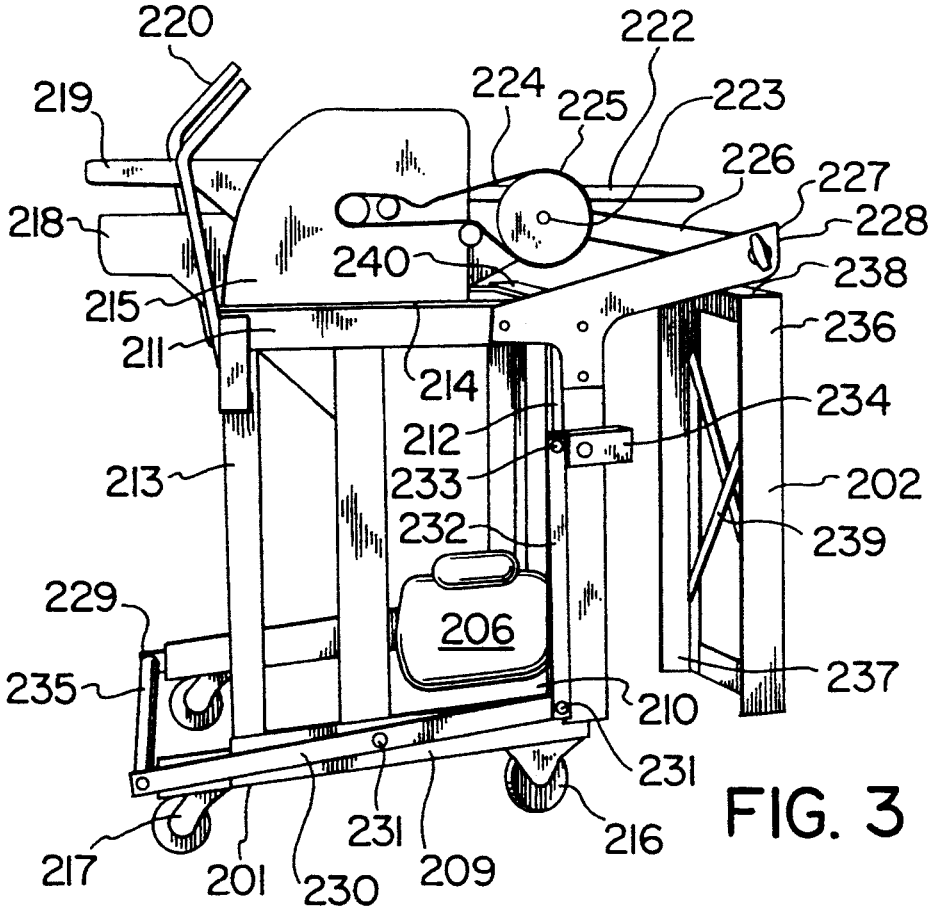
FIG. 3 is a side, partially-perspective view of one embodiment of a feeder module of an offset press unit of one embodiment of this invention, viewed from the right hand side.

(ii) Description of FIGS. 2 and 3

Referring to FIGS. 2 and 3 of the drawings, the feeder module 200 has a base frame 201, a feeder unit docking subframe 202, a feeder and registration assembly 203, a coupling assembly 204, a latch assembly 205, a compressor 206, electrical connection means 207, moveable means 208, and various controls, linkages and other means.

The base frame 201 includes a pair of longitudinally extending base channels 209 and a forward cross piece 210, a pair of longitudinally-extending upper channels 211, interconnected by four uprights, i.e. two forward uprights 212 and two rear uprights 213 and forward cross piece 214 and a rear cross piece 215. The base channels 209 are provided with a pair of forward casters 216 and a pair of rear swivel casters 217.

Mounted on the upper channels 211 and cross-pieces 214,215, are the usual components of a feeder module, i.e. the feeder table 218, the side/rear guide bracket 219 and the handle 220 at the rear. The feed push arm 221, the conveyor table 222, and the intermediate shaft 223 are also seen in FIG. 2. Mounted on the rectangular box frame is a unit 239 within which are mounted the master cylinder 101, blanket cylinder 102 and the impression cylinder as described in FIG. 1. These cylinders, as well as the inking cylinders 104 and the wetting cylinders 107, also described in FIG. 1 are not seen. FIG. 3, in addition, shows the secondary drive chain 229, the secondary drive sprocket 225, the primary drive chain 226, the clutch bracket 227 and the clutch handle 228.

The feeder module 200 is provided with a treadle mechanism 229. Treadle mechanism 229 includes a pair of lower longitudinal linkages 230, each pivotally mounted at 231 to a receptacle base channel 209 and pivotally secured, at 231 to a vertical linkage 232, which in turn is connected at 233 to a latch plate 234. The longitudinal linkages 230 are interconnected by a foot treadle 235.

The feeder module docking subframe. 202 consists of a rectangular box framework 236, consisting of two vertical 237 and two horizontal members 238, braced by "X" brackets 239. The docking subframe 202 includes a latch plate 234 for latching engagement to the minor latch plate 638 of the press unit 600 (to be described with references to FIG. 4).

While one embodiment of the feeder module docking subframe has been described, that docking subframe is merely one embodiment of a generic class of feeder module docking subframe and other designs may be used. For example, in a preferred embodiment, the construction is a one-piece, die cast subframe.

The docking subframe 202 which is secured to the feeder module 200 includes a plurality of upper alignment pins 240, on the latch plate 239. It also provides the site for the vacuum and pressure controls 241. The docking subframe 202 is preferably constructed by welding or by die casting and machining.

Figure 4:
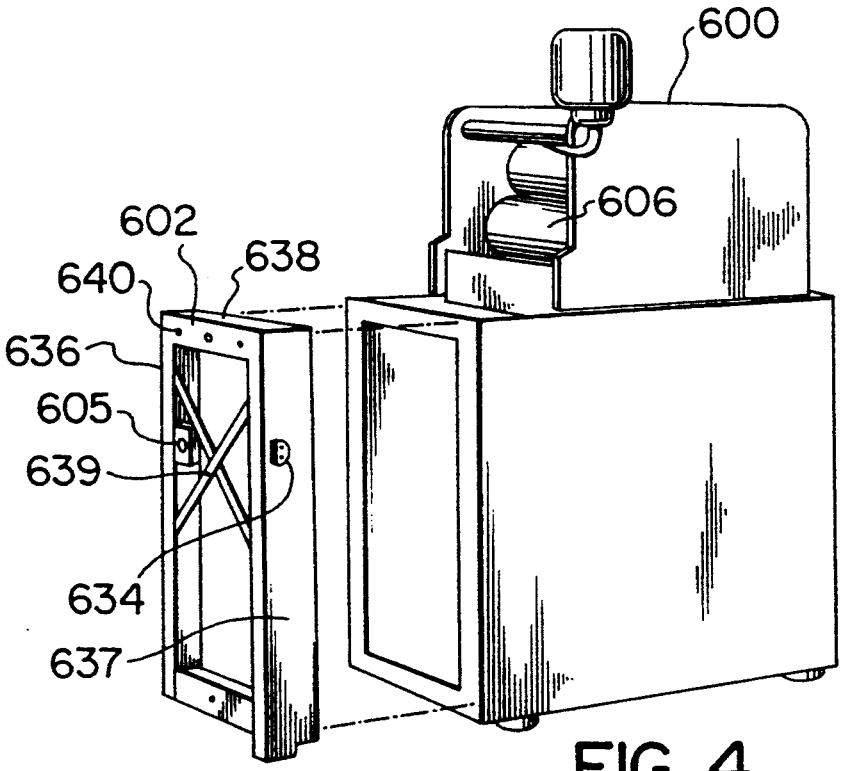
FIG. 4 is a side, partially-perspective view of one embodiment of a press unit of an offset press of one embodiment of this invention, viewed from the right hand side.

(iii) Description of FIG. 4

As seen in FIG. 4, the press unit 600 has a base frame 601, a docking subframe 602, a coupling mechanism 604, electrical receptacle means 605, printing assembly 606, delivery mechanisms 607 for receiving printed sheets 608 and controls, linkages and other means.

The other relevant components of the press unit 600, e.g., the minor plate, the clutch, the holes for the alignment pins, etc., have been previously described with references to FIGS. 2 and 3, and so will not be further described herein. Moreover, the presses of the press unit vary in design from model to model and hence the specific details of the press is not relevant to the present invention. Only the docking subframe is relevant.

The press unit docking subframe 602 consists of a rectangular box framework 636 consisting of two vertical 637 and two horizontal members 638, braced by "X" brackets 639. The press unit subframe 602 includes a minor latch plate 640 which for latching engagement to the latch plate 239 of the feeder module 200. The press unit docking subframe 600 is preferably constructed by welding or by die casting and machining.

While one embodiment of the press unit docking subframe has been described, that press unit docking subframe is merely one embodiment of a generic classe of docking subframes and other designs may be used. In a preferred embodiment, the construction is a one-piece, die cast and machined subframe.

Guidance of the feeder module base docking subframe 202 into docking position is assisted by a long guide pin 664 at the top of the frame.

Figure 5:
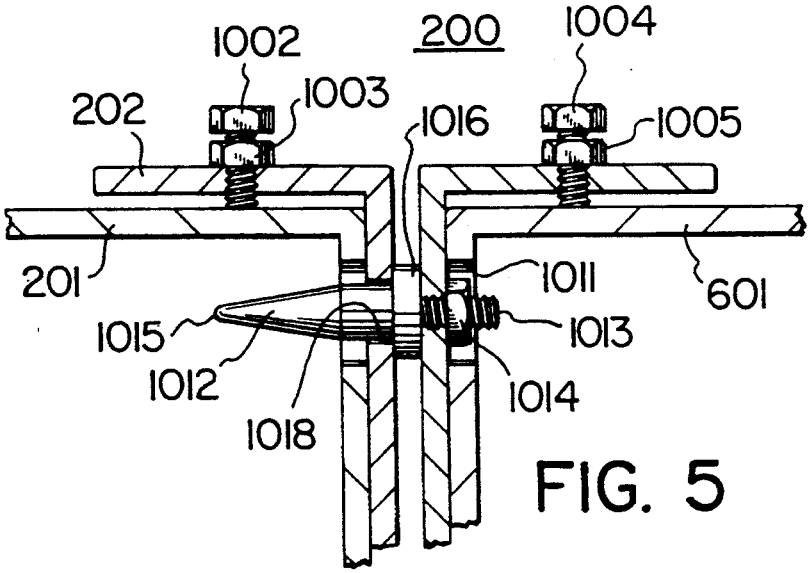
FIG. 5 is a top plan view of a detail of the subframe and showing one embodiment of an alignment system.

(iv) Description of FIG. 5

One, though not limiting, means of securing the subframes 202,602 temporarily, but in fully aligned manner, is shown in FIG. 5. Base frame 201 of the feeder module 200 has a hole 1010 bored therethrough. The feeder module subframe unit 202 is secured to the feeder module frame 201 by a plurality of jack bolts 1002 and lock nuts 1003 to adjust the alignment of the subframe 202. Base frame 601 of the press unit 600 has a hole 1011 bored therethrough, into which an alignment pin 1012 is secured by a bolt 1013 and nut 1014 combination. The press unit subframe 602 is secured to the press unit frame 601 by a plurality of jack bolts 1004 and lock nuts 1005 to adjust the alignment of the subframe 602. The alignment pin 1012, which includes a conical nose 1015 and a cylindrical base 1016 fits into the alignment holes 1010,1018 of the feeder module frame 201 and feeder module subframe 202.

Figure 6:
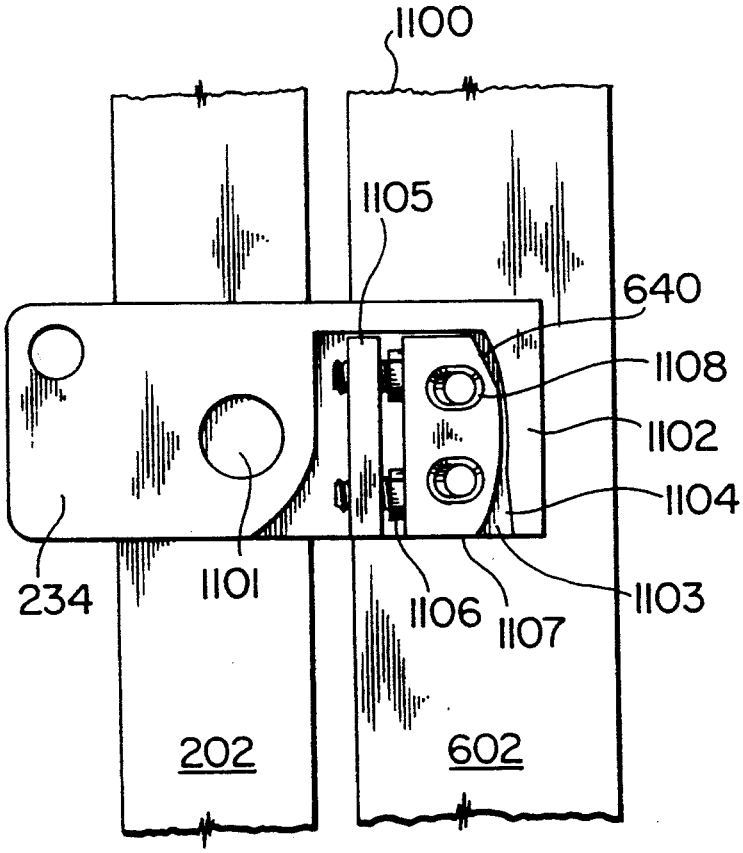
FIG. 6 is a plan view of one embodiment of a latch forming part of one embodiment of the present invention.
Figure 7A:
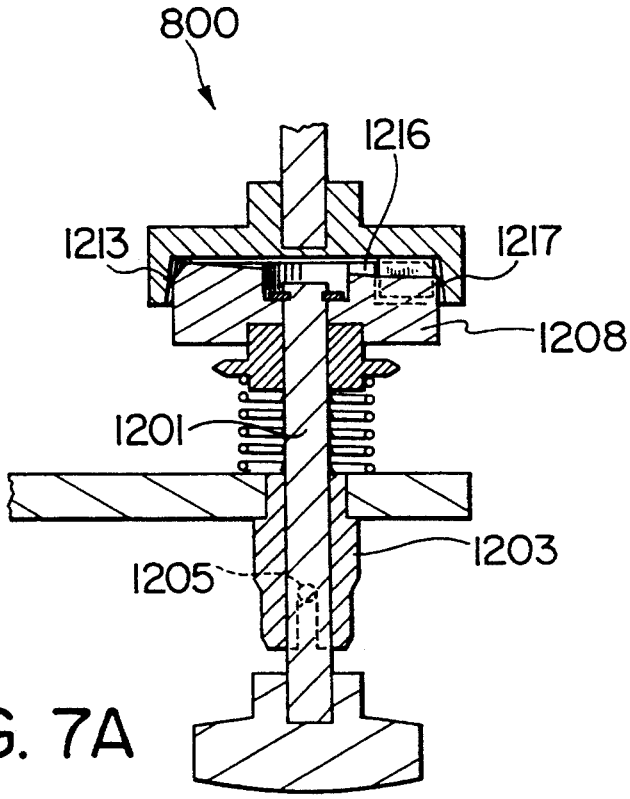
FIG. 7A and FIG. 7B are longitudinal cross-sectional views of one embodiment of a clutch assembly forming part of one embodiment of the module feeder system of the present invention, FIG. 7A being in the engaged position and FIG. 7B being in the disengaged position.
Figure 7B:
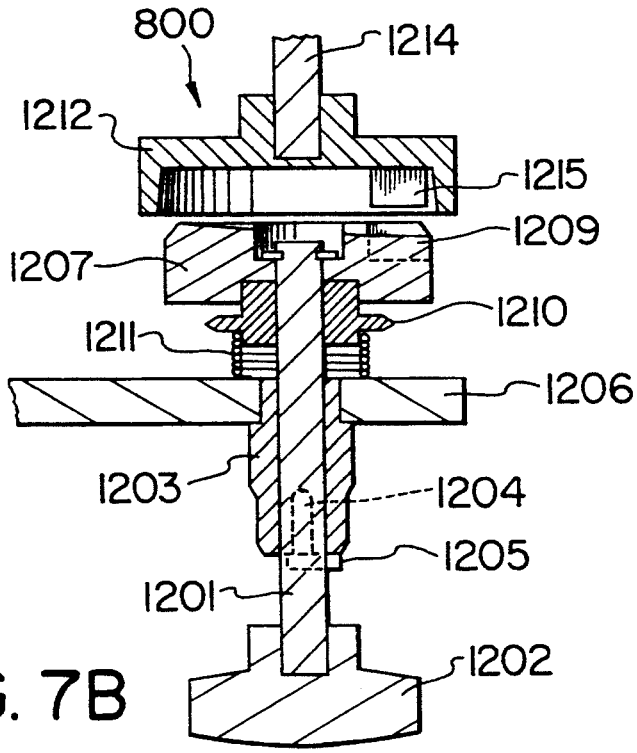

(v) Description of FIG. 6

One, though not limiting, form of latch assembly 1100 is shown in FIG. 6 in its latched orientation. The latch plate 234 is secured to the feeder module sub-frame 202 through two holes 1101. The latch plate 234 includes an overhang portion 1102 which is provided with a pocket 1103, terminating in a ramp section 1104.

The minor latch plate 640 is secured to a mounting bracket 1105 by means of a pair of jackscrews 1106. The mounting bracket 1105 is provided with a pair of round holes 1107, while the minor latch plate 640 is provided with slotted holes 1108. This enables the minor latch plate 640 to be secured with no difficulties to press unit subframe 602 projecting out of the round holes.

(vi) Description of FIGS. 8A and 8B

One, though not limiting, form of clutch assembly 1200 is shown in FIG. 8A in engaged orientation and as shown in FIG. 8B in disengaged orientation. The clutch assembly 1200 includes a clutch shaft 1201, provided with a handle 1202 and surrounded by a clutch collar 1203. The clutch collar 1203 is provided with a slot 1204 for the collar pin 1205. The clutch assembly 1200 is secured by a clutch bracket 1206.

The clutch plate 1207, of the male clutch 1208, is secured to the opposite end of the clutch shaft 1201 and includes a drive pin receptacle 1209. The male clutch 1208 is secured to a sprocket 1210, which is separated from the clutch bracket 1206 by a spring 1211.

The clutch plate 1212, of the female clutch 1213, is secured to the press drive shaft 1214. This clutch plate 1212 includes a drive pin 1215 engageable with the drive pin receptacle 1209 of the male clutch plate 1207.

Figure 8:
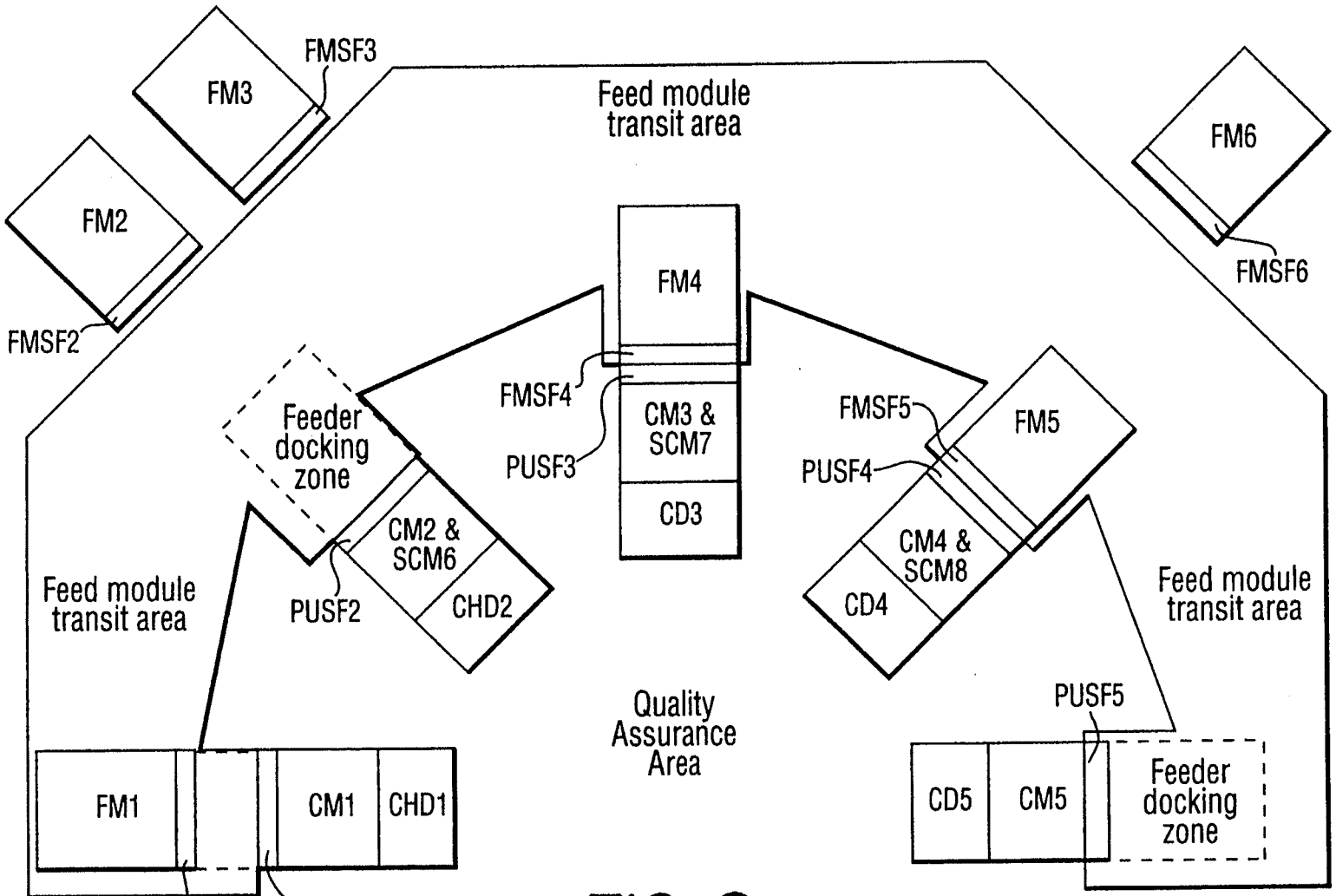
FIG. 8 is a preferred floor configuration of a system with five presses using six modular feeders.
Figure 9:
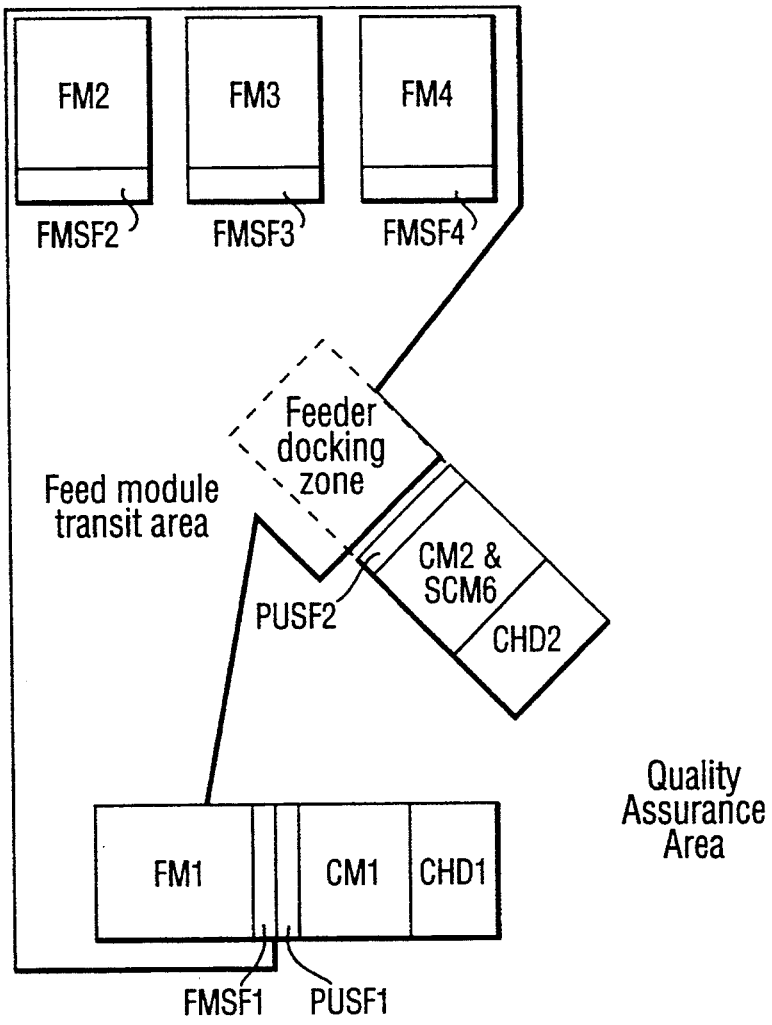
FIG. 9 is a preferred floor configuration of a system of this invention with two presses using four modular feeders.

Description of FIGS. 8 and 9

FIGS. 8 and 9 show some permutations and combinations of the modular feeder printing system of the present invention. As seen in the floor plan of FIG. 8, a U-shaped feeder module transit area-is shaded grey and is provided with five feeder docking zones (FD2). A press unit (PU) is disposed at each of these feeder docking zones (FD2). The press units (PU) are each provided with a press unit docking subframe (PUSF) and with various combinations of presses, i.e.: a color module (CM1) and a chute delivery (CHD1); or a color module (CM2)/secondary color module (SCM6) and a chute delivery (CHD2); or a color module (CM3)/secondary color module (SCM7) and chute delivery (CD3); or a color module (SCM8) and chute delivery (CD4); or a color module (CM5) and a chute delivery (CD5). The feeder module (FM) are each provided with a feeder module subframe (FMSF). Three of the feeder modules (FM1, FM4 and FM5) are disposed in feeder docking zones (FD2), while three feeder modules (FM2, FM3 and FM6) are disposed at the periphery outside the feed module transit area. The interior of the U-shaped feeder module transit area provides a quality assurance area.

As seen in the floor plan in FIG. 9, the feeder module transit area is generally trapezoidally-shaped and is shaded grey. It is provided with two feeder docking zones (FD2). A press unit (PU) is disposed at each feeder docking zone (FD2). Each press unit includes a press unit subframe (PUSF) and various combinations of presses, i.e.: a color module (CM1) and a chute delivery (CD1); or a color module (CM2)/secondary color module (SCM6) and a chute delivery (CH2). At one area within the feeder module transit area are three feeder modules (FM2, FM3 and FM4) provided with feeder module subframes (FMSF2, FMSF3 and FMSF4, respectively). On feeder module (FM1) having a feeder module subframe (FMSF1) is situated within the feeder docking zone (FD2).

The area outside the feed module transit area is a quality assurance area.

The feeder modules also include various combination for different sizes of paper to be fed and printed on. For example: FM1 may be for, e.g., $8\frac{1}{2}''\times 11''$ paper; FM2 may be for e.g., business card size paper; FM3 may be for e.g., $11''\times 17''$ size paper; FM4 may be for e.g., $8\frac{1}{2}''\times 14''$ size paper; FM5 may be for variable size paper; and FM6 may include an envelope feed.

Manufacture of One Embodiment of the Invention

In one non-limiting manufacturing procedure (i.e. retrofitting), the frame for the press unit and the feeder module of the prior art is separated at a location underneath the registration table aft of the vertical support members of the frame. With the printing assembly, feed and registration assembly, and cover panels removed, a jig is inserted accurately in the horizontal support bars for the printing unit, and is bolted in place. One horizontal cross bar is held in place at the top of the frame and one at the bottom of the frame by the jig, and the bars are welded in place. Two similar bars are similarly positioned on the feeder side of the frame with spacers between the bars on the press side and the feeder side of the frame. The crossbars on the feeder side are welded in place. The four longitudinal frame members of the frame are then cut and cut edges finished.

The frame of the press is either built separately from the feeder module frame during manufacture, or is cut at the preferred location during retrofit and new frame members added. The conveyor table is suitably supported with modified brackets before the feeder/registration system is separated from the printing unit. Other parts of the press unit, feeder and registration assembly are basically of conventional construction. The invention can be adopted to any sheetfed printing presses. For larger and heavier presses, power driven or power assisted moveable means may be necessary to move the feeder modules.

The sub-frame which is secured to each press unit has a plurality of alignment holes and a minor latch plate.

A subframe is built for the docking interface on the press side, and a matching subframe is fabricated for the feeder side. After welding and cross bracing, the facing surfaces of both subframes are machined and exact openings are bored on the facing surfaces on both sides to receive respective alignment pins accurately. Holes are bored on both sides of the printing unit subframe for mounting the latching mechanism. Similarly, holes are bored on the feeder module subframe for pivotally mounting the latches, and the clutch assembly bracket. Other holes are bored and tapped on both subframes to receive jack bolts to calibrate the exact location of each subframe, and to bolt the subframe to the respective base frames. Once calibrated and latched in position, each feeder module will deliver a print sheet to an exact location relative to the printing image on each press.

Assembly of the Feeder Module Subframe

After welding and cross bracing, the facing surface of subframe 202 is machined and exact openings 260 are bored on such surface to receive alignment pins 261 accurately. Holes 262 are bored on the feeder module subframe 201 for pivotally mounting the latches 234, and the clutch assembly bracket 1206. Other holes 1010 are bored and tapped on subframe 202 to receive jack bolts 1002 to calibrate the exact location of the subframe 202, and to bolt the subframe 202 to the base frame 201 of the feeder module 200.

Assembly of the Press Unit Subframe

After welding and cross bracing, the facing surface of press unit subframe 602 is machined and exact openings 660 are bored on such surfaces to receive alignment pins 661 accurately. Holes 662 are bored on both sides of the printing unit subframe 602 for mounting the latch plate 640. Other holes 1015 are bored and tapped on subframe 602 to receive jack bolts 1004 to calibrate the exact location of each subframe 602., and to bolt the subframe 602 to the base frame 600.

Operation of One Embodiment of the Invention

Once the feed module is docked and latched, the spring-loaded male clutch plate on the feeder is turned and released to engage the female clutch plate on the press side. A ramp machined into the surface of the male clutch plate guides a square pin on the female clutch plate into a notch on the male clutch plate. Mechanical power is thus transmitted automatically from the press unit to the feeder module, in correct rotational position with respect to the press cylinders. A series of sprockets and chains transmit this power to the register board conveyor rollers. An intermediate shaft also transmits power to the jogger on the register board and suction lifting mechanisms of the feeder system.

The latch mechanism is actuated by a foot treadle, linked to the latch plate on each side by a vertical linkage and a horizontal linkage. Depressing the foot treadle engages the latches, and lifting on the treadle disengages the latches.

As in conventional feeder mechanisms, separation of the top sheets in the paper pile is achieved by air blowers, while suction for the lifting mechanism is provided by vacuum; both blower and vacuum is supplied by a compressor and are regulated by control valves. In the preferred embodiment of the invention, the compressor and the control valves are relocated to the feeder module to allow the optimal vacuum and blower pressure settings to be saved for reuse. Electrical power for the compressor is supplied through a separate docking connector, with a plug on the feeder module automatically docking into a receptacle on the press unit. Electrical power is also supplied through the same connection to the doublefeed detector and other necessary electrical systems on the feeder module.

Once docked and latched in, and the mechanical clutch engaged, the printing unit and the feeder performs exactly as on a conventional printing press. No special training is required for operators who are already familiar with conventional printing press operation.

Operation of One Embodiment of the Clutch Mechanism

In the operation of the clutch mechanism, the spring loaded clutch plate 1207 on the feeder module 200 is turned on and released to engage the female clutch plate 1214 on the press side. The ramp 1216 machined into the surface of the male clutch plate 1207 guides a square pin 1217 on the female clutch plate 1212 into a notch 1219 on the male clutch plate 1207. Mechanical power is thus transmitted automatically from the press unit 600 to the feeder module 200, in correct rotational position with respect to the press cylinders. A series of sprockets and chains (previously described) transmit this power to the register board conveyor rollers (previously described). An intermediate shaft also transmits power to the jogger on the register board and suction lifting mechanisms of the feeder system.

ADVANTAGES OF THE PRESENT INVENTION

The accuracy of docking of the feed modules to the press unit is assured by means of alignment pins at the interface of the press unit and the feeder module. Guide pin(s) are also used to help align the alignment pins before final docking position is reached. The separate adjustable subframe or similar interface mechanism on both the press unit and the feeder module as previously described allows calibrating all horizontal and vertical alignments of the interface to compensate for variations in the manufacturing tolerances on each press. Once docked, the bilateral latching system, previously described, can be quickly engaged to secure the press unit and the feeder module together. The clutch assembly, previously described, drawing mechanical power from the printing press unit, provides synchronized drive power to the register board and feeder mechanisms through a series of chain-and-sprocket mechanisms. In cases where the compressor for the feeder mechanisms air and vacuum supply is located on the press side, as previously taught, it is relocated to the feeder module side along with the controls for metering the delivery of vacuum and blower pressures. Electrical power is transmitted to the compressor on the feeder module via a grounded plug and receptacle system.

The substantial reduction in set-up time also means that multiple printing press units can be configured in a hub-and spoke configuration to facilitate quality control of multiple presses by one operator at the central location. This procedure can reduce the number of operators required to operate a particular number of presses. The standardization of settings on the feeder modules, when used with procedures for accurately positioning the printing image on the printing plates, further allows for almost instant registration of the image position on the printing sheet.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A modular sheetfed printing press comprising:

(a) at least one printing unit;

(b) at least one feeder module;

(c) an alignment means incorporated at an end of each printing unit, said alignment means being adapted to be connected to an associated feeder module;

(d) a complementary alignment means incorporated at an end of each feeder module, said complementary alignment means being adapted to be connected to an associated printing unit, and said complementary alignment means being alignable and engagable with said alignment means;

(e) latch means, cooperatively associated with said alignment means, to secure a selected printing unit to a selected feeder module; and (f) coupling means to couple and synchronize drive power from the printing unit to the connected feeder module.

2. The modular feeder system of claim 1 wherein said alignment means (c) comprises a subframe secured to said printing unit, said subframe including one component of said latch means.

3. The modular feed system of claim 1 wherein said complementary alignment means (d) comprises a subframe secured to said feeder module, said subframe including another component of said latch means.

4. The modular feeder system of claim 2 wherein said subframe is secured to said printing unit by jack bolts to calibrate the exact position of each subframe.

5. The modular feeder system of claim 3 wherein said subframe is secured to said feeder module by jack bolts to calibrate the exact position of each subframe.

6. The modular feeder system of claim 1 including a female clutch plate and male clutch plate in separate printing units and feeder modules, said clutch plates being engageable after said feeder module and said printer unit have been docked and latched, thereby to transmit power automatically from said press unit to said feeder module.

7. The modular feeder system of claim 6 wherein said male clutch plate is secured to said feeder module, and wherein said female clutch plate is secured to said press unit.

8. The modular feeder system of claim 1, including a docking connection for electrical power, said docking connection including a plug and a receptacle on said feeder module and said press unit.

9. The modular feeder system of claim 8 wherein said plug is on said feeder module and wherein said receptacle is in said press unit.

10. The modular feeder system of claim 3 including a alignment system on said subframe which is secured to said feeder module, said alignment system being provided with a guide pin to guide said feeder module subframe into docking position.

11. The modular feeder system of claim 1 wherein said latch means is actuated by a foot treadle on said feeder module.

12. The modular feeder system of claim 1 including alignment pins at the interface between said press unit and said feeder module to assure accuracy of docking.

* * * * *